US009649773B2

(12) United States Patent
Zuzik

(10) Patent No.: US 9,649,773 B2
(45) Date of Patent: May 16, 2017

(54) DEVICE AND METHOD FOR CUTTING HOLLOW, THIN-WALLED OBJECTS

(71) Applicant: BERRAN INDUSTRIAL GROUP, INC., Kent, OH (US)

(72) Inventor: Paul J. Zuzik, Hubbard, OH (US)

(73) Assignee: BERRAN INDUSTRIAL GROUP, INC., Akron, OH (US)

( * ) Notice: Subject to any disclaimer, the term of this patent is extended or adjusted under 35 U.S.C. 154(b) by 304 days.

(21) Appl. No.: 14/457,476

(22) Filed: Aug. 12, 2014

(65) Prior Publication Data

US 2016/0046030 A1 Feb. 18, 2016

(51) Int. Cl.
*B26D 1/45* (2006.01)
*B26D 5/08* (2006.01)
*B26D 3/16* (2006.01)

(52) U.S. Cl.
CPC ..... *B26D 1/455* (2013.01); *B26D 5/08* (2013.01); *B26D 3/16* (2013.01)

(58) Field of Classification Search
CPC . B26D 1/455; B26D 5/08; B26D 3/16; G01N 1/06; Y10T 83/8874; Y10T 83/04
USPC ..... 83/52, 56, 13, 646, 508.3, 701, 699.21, 83/783, 932, 654, 751, 789, 801, 788, 83/800, 809–813, 647, 647.5, 661, 808, 83/794, 797
See application file for complete search history.

(56) References Cited

U.S. PATENT DOCUMENTS 1,726,772 A * 9/1929 Skowron ..... B27B 21/00 83/455
3,429,211 A 2/1969 Pelot
3,537,351 A * 11/1970 Eck ..... B23D 51/16 83/647
4,487,097 A * 12/1984 Hara ..... B23D 53/04 83/56
5,091,042 A * 2/1992 Bruckner ..... B26D 3/28 156/254
5,213,022 A * 5/1993 Elgan ..... B23D 53/04 83/797
5,511,648 A 4/1996 Kaminski et al.
5,967,010 A 10/1999 van Mansen
8,276,493 B2 * 10/2012 Dale ..... B23D 55/02 83/788
2005/0081692 A1 * 4/2005 Mosiewicz ..... A01J 25/12 83/508.3
2008/0202306 A1 * 8/2008 Tokiwa ..... B23D 55/082 83/661
2010/0175520 A1 * 7/2010 Kong ..... G01N 1/06 83/13

* cited by examiner

*Primary Examiner* — Ghassem Alie
(74) *Attorney, Agent, or Firm* — Hudak, Shunk & Farine Co. LPA

(57) ABSTRACT

A method for cutting or trimming a hollow object having one or more relatively thin walls, the method including an oscillation step that reduces wall deformation at the site of the initial cut to produce a relatively straight leading edge on the object, in combination with a further cutting step that does not include oscillation of a cutting blade. A second oscillation step can be performed after the non-oscillation step that leads to the separation of the object into two pieces and also produces a relatively straight trailing edge. A device for performing the cutting methods is disclosed.

17 Claims, 7 Drawing Sheets

First Stage
Home Position
No Oscillation

Second Stage
First Oscillation

Third Stage
With or Without Oscillation

Fourth Stage
Exit Cut with Oscillation

DEVICE AND METHOD FOR CUTTING HOLLOW, THIN-WALLED OBJECTS

FIELD OF THE INVENTION

The present invention relates to a method for cutting or trimming a hollow object having one or more relatively thin walls, the method including an oscillation step that reduces wall deformation at the site of the initial cut to produce a relatively straight leading edge on the object, in combination with a further cutting step that does not include oscillation of a cutting blade. A second oscillation step can be performed after the non-oscillation step, as the cut begins to exit the part, that leads to the separation of the object into two pieces and also produces a relatively straight trailing edge. A device for performing the cutting methods is disclosed.

BACKGROUND OF THE INVENTION

Hollow objects or parts having relatively thin walls, such as those formed from plastic, can be difficult to cut or trim to produce a finished part having a relatively straight edge. At the start of a cutting operation, when utilizing a knife or other cutting device with a fixed blade, the material of the object can deflect inwardly and away from the pressure exerted by the blade, generally until the blade enters the material. Once the blade has cut or been passed through a portion of the material, a straight-line cut can be produced until reaching the end point of the object at which time the material thereof may deflect outwardly, away from the cutting pressure, until the blade separates the object or article into two pieces. Thus, in some embodiments the finished part may have a cut-finished end with a scalloped appearance, wherein the leading edge and trailing edge of the object is longer than a central area.

Although various cutting devices are known to those of ordinary skill in the art, for example knives, saws, routers, hot knives, ultra sonic knives, and guillotines, the art still needs a method for cutting hollow, relatively thin-walled articles or objects that results in a finished product having a relatively straight edge.

SUMMARY OF THE INVENTION

In view of the above, it is an object of the present invention to provide a method for cutting or trimming a thin-walled, hollow object or article to produce a finished article having a relatively straight-edged surface.

Still another object of the present invention is to provide a process for cutting or trimming hollow plastic molded parts using at least two different cutting sequences including an oscillation step wherein a knife or blade, preferably having a straight, non-serrated edge, is oscillated while cutting through a portion of the article, thereby reducing or preventing distortion of the part, and a second step free of the oscillation during cutting.

Yet another object of the present invention is to provide an oscillation cutting step, wherein a knife or blade is oscillated during first contact of the knife or blade on an uncut hollow plastic part or object, wherein the oscillation occurs, generally transverse or perpendicular to a cutting axis in one embodiment, while the knife or blade is moved along the cutting axis and further into the part or object.

A further object of the present invention is provide a method which discontinues an oscillation of the knife or blade after the knife or blade has entered into the object a desired distance, wherein the knife or blade continues to cut the object as the knife or blade is moved along the cutting axis.

Still another object of the present invention is to perform a second oscillation step after a non-oscillation step as the knife or blade approaches an end of the object opposite the first end of the object first cut by the knife or blade. The second, further oscillation step is continued until the object is cut into two pieces or a desired cutting operation has otherwise been performed.

In a further aspect, the knife or blade can be oscillated during the entire cutting process.

In one aspect of the invention, a method for cutting an object having a wall and at least one hollow portion is disclosed, comprising the steps of obtaining the object; cutting the object using at least two different cutting sequences, including an oscillation step wherein a blade is oscillated while first contacting and cutting into a portion of the object followed by a second step of cutting the object without oscillating the blade.

In another aspect of the invention, a cutting method for objects having a hollow portion is disclosed, comprising the steps of: obtaining an object to be cut; obtaining a cutting device comprising a frame and a carriage movable in relation to the frame along a cutting axis, an oscillating device connected to the carriage and arranged to selectively oscillate the carriage on a second oscillating axis arranged from about 35° to 90° in relation to the cutting axis, and a cutting blade having a cutting edge for cutting the object; moving the carriage towards the object along the cutting axis and oscillating the cutting blade prior to and/or during first contact of the object with the cutting blade; and ceasing oscillation of the cutting blade after a period of time and continuing to cut the object with the cutting blade along the cutting axis.

In yet another aspect of the invention, a cutting device is disclosed, comprising a frame and a carriage movable in relation to the frame along a cutting axis, and oscillating device connected to the carriage and arranged to selectively oscillate the carriage on a second oscillating axis arranged at an angle of about 35° to 90° in relation to the cutting axis, and a cutting blade having a cutting edge for cutting the object operatively connected to the carriage.

BRIEF DESCRIPTION OF THE DRAWINGS

The invention will be better understood and other features and advantages will become apparent by reading the detailed description of the invention, taken together with the drawings, wherein:

FIG. 4A, FIG. 4B, FIG. 4C and FIG. 4D visually illustrate one embodiment of a cutting method of the present invention wherein FIG. 4A shows a first stage wherein the carriage is located at a home position prior to being advanced toward the article, FIG. 4B shows a second stage wherein the carriage has been advanced towards the article and is oscillated while cutting through a first portion of the article, FIG. 4C shows a third stage illustrating the cutting knife or blade cutting the article along the cutting axis while no oscillation is being performed, and FIG. 4D shows a fourth stage wherein oscillation is resumed as the cutting knife or blade approaches the second or distal end of the article opposite the first end of the object cut by the knife or blade.

DETAILED DESCRIPTION OF THE INVENTION

Figure 1:
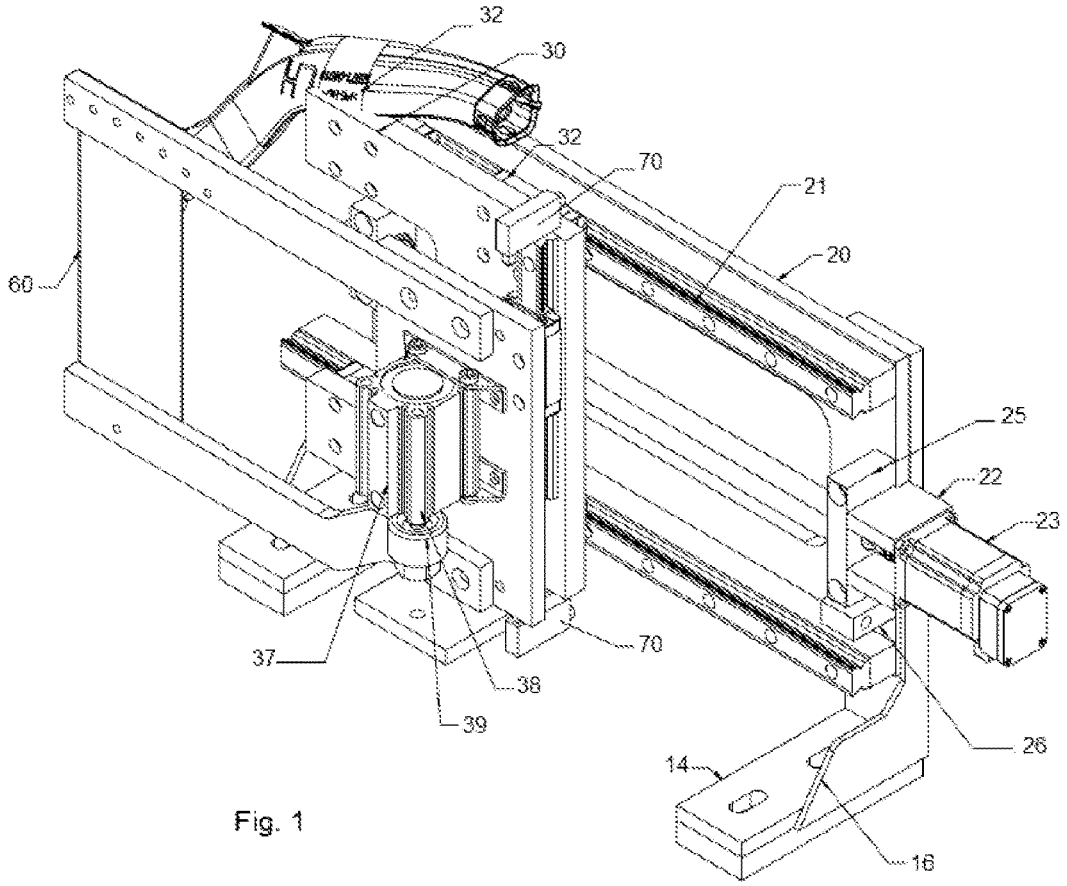
FIG. 1 is a perspective view of one embodiment of a cutting device of a present invention suitable to perform the cutting methods described herein.

This description of preferred embodiments is to be read in connection with the accompanying drawings, which are part of the entire written description of this invention. In the description, corresponding reference numbers are used throughout to identify the same or functionally similar elements. Relative terms such as "horizontal," "vertical," "up," "upper", "down," "lower", "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and are not intended to require a particular orientation unless specifically stated as such. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

The methods or processes of the present invention for cutting hollow, thin-walled objects or parts, such as plastic parts utilize two or more cutting steps in sequence, including a first cutting step wherein a straight, non-serrated knife or blade is oscillated in a direction other than along a cutting axis and contacted with a leading edge of the part at a location desired to be cut. The second cutting step is a non-oscillation cutting procedure that is performed by pushing or pulling the knife or blade through a portion of the part along the cutting axis after the first cutting step has been performed. In a preferred embodiment, a second oscillation cutting step is performed after the non-oscillation step as the knife or blade approaches a distal end of the part. The second oscillation step is continued until the part is cut into two pieces.

The methods of the present invention solve various problems of the prior art methods that are encountered when cutting an object or part into a final shape. Relatively thin-walled, hollow, plastic parts such as formed by blow molding, rotational molding or other process are only semi-rigid in some embodiments. When pressure from a knife or blade is exerted onto the outside of a hollow plastic part, the knife or blade can deform the part, sometimes to the extent that the part is no longer within manufacturing tolerances. The manufacturing tolerances may vary with different applications, but can be relatively small. The methods of the present invention provide an economical cutting process that reduces deformation of the plastic part and provides a straight or square edge to the finished part.

Figure 2:
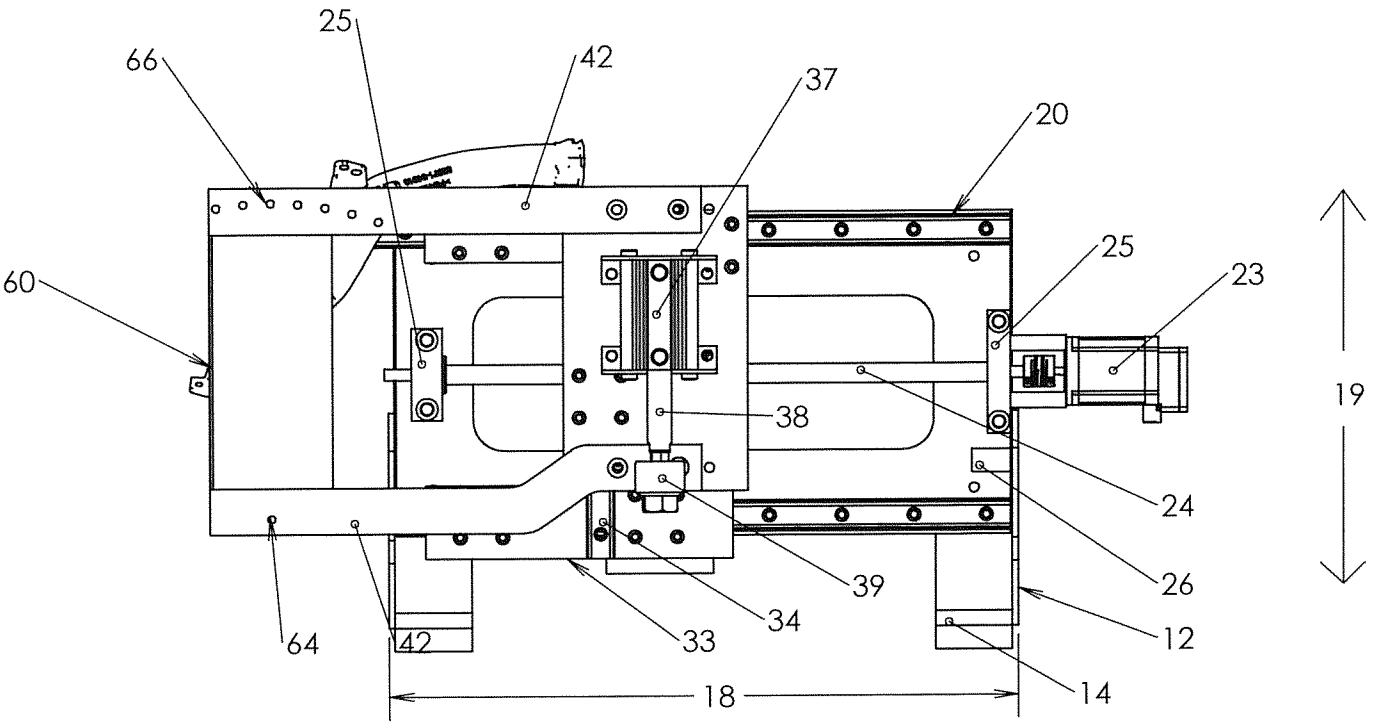
FIG. 2 is a front view of the device illustrated in FIG. 1.
Figure 3:
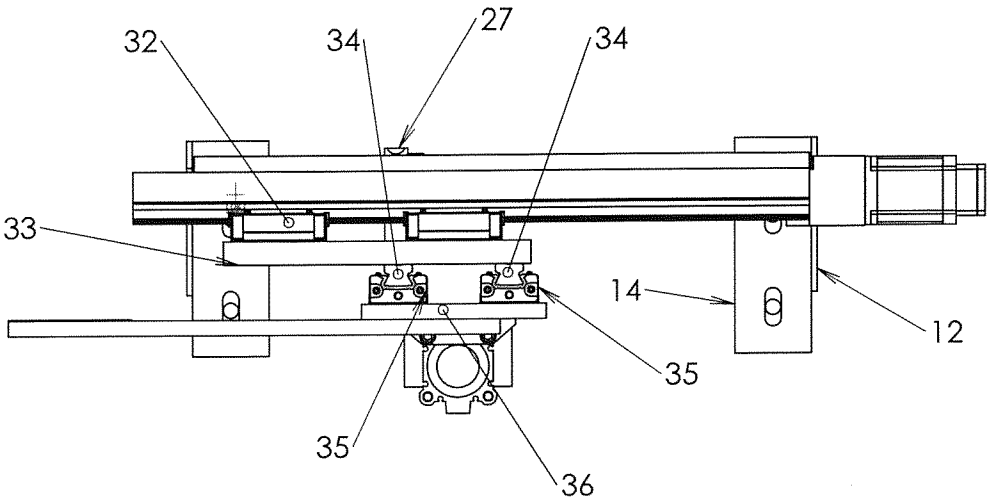
FIG. 3 is a top view of the device illustrated in FIG. 1.

Referring now to the drawings, FIGS. 1-3 illustrate a cutting device 10 including a base or frame 12 having a mounting surface 14 that is adapted to be placed upon and/or connected to a support surface via a fastener or other suitable attachment element(s). Support gussets 16 are utilized in some embodiments to provide rigidity to cutting device 10.

A guide rail assembly 20 is connected to the frame 12 for moving carriage along a linear cutting axis 18. The cutting axis utilized allows the cutting knife or blade 60 to cut or trim a desired object or part into two or more separate pieces. Guide rail assembly 20 includes one or more guide rails 21 that direct carriage 30 along cutting axis 18 and engage with one or more carriage bearings 32 of carriage 30 that comprise linear bearings in one embodiment. Carriage bearings 32 provide low friction travel of the carriage 30 on the guide rail assembly 20.

A drive system 22, a screw drive in one embodiment, is present on the guide rail assembly. Drive system 22 includes a servo motor 23 operatively connected to a screw 24 that is connected to the guide rail assembly 20 by two bearings supports 25. A screw drive nut 27 operatively connected to screw 24 is connected to carriage 30, in one embodiment by connecting a suitable bracket between the screw drive nut 27 and carriage 30. The screw drive nut 27 drives the carriage 30 forward or backward along cutting axis 18 when the servo motor 23 is actuated.

A carriage mount plate 33 connected to carriage bearings 32 includes a carriage guide rail assembly 40, see FIG. 3, having a carriage guide rail 34 fixedly connected to mount plate 33. Carriage guide rail assembly 40 additionally includes oscillating axis bearings 35, which are linear bearings in one embodiment. Carriage guide rail 34 and oscillating axis bearing 35 are arranged so that the carriage 30 can be moved or oscillated on an axis 19, transverse or perpendicular to cutting axis 18 in one embodiment. In some embodiments, the axis 19 is arranged at an angle a from about 35° to 90° and desirably from about 45° to 90° in relation to cutting axis 18 in order to provide a desired oscillating motion.

Figure 4A:
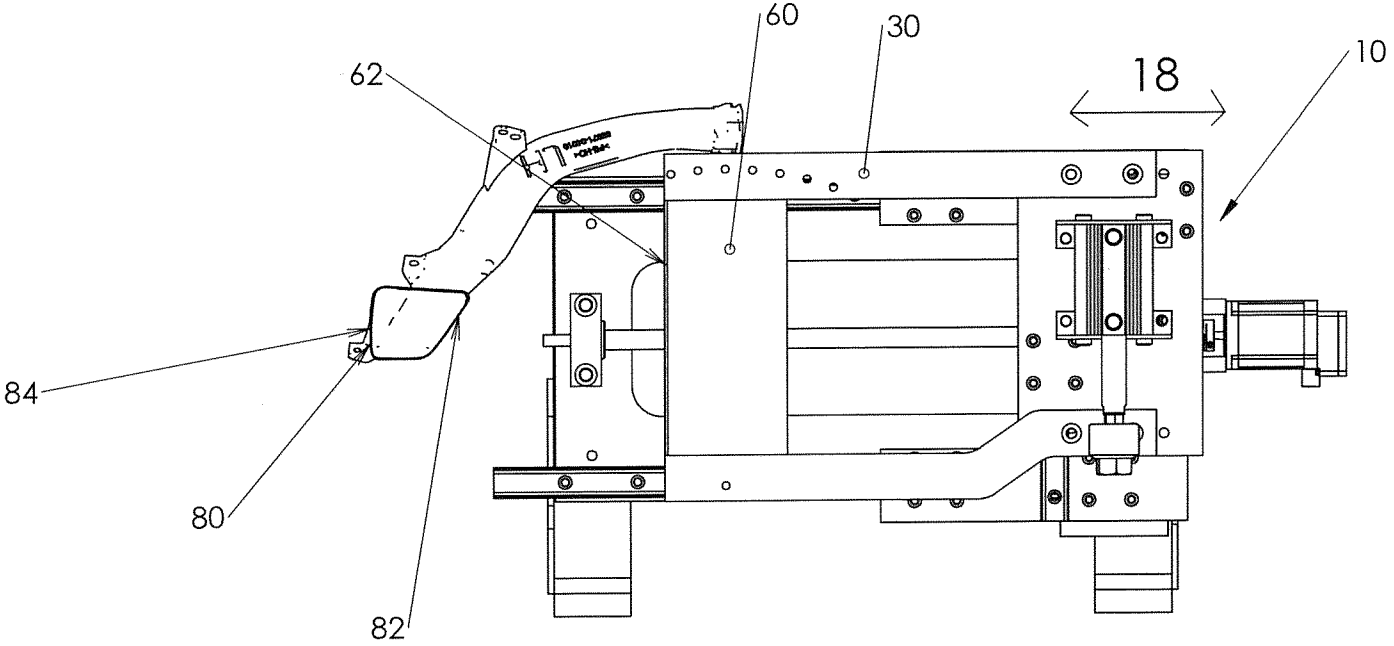

A cutting blade mount plate 36 is connected to oscillating axis bearings 35 and oscillating device 37, such as an air cylinder in one embodiment is connected to cutting blade mount plate 36. The oscillating device 37 includes an actuating rod 38 connected to an actuator end 39. The oscillating device 37 provides the oscillation by using two limit sensors 70, which sense the location of the cylinder. By using sensors 70, the frequency of the oscillation can be adjusted by moving the sensors. The oscillation process is started in one embodiment when the carriage 30 reaches a pre-programmed position along guide rail 21. Once this position is reached, the oscillation device 37 is activated, causing the carriage 30 to move to a second position, see FIG. 4B) for example. Once the carriage 30 reaches the other sensor it is sent back to the first position by oscillation device 37. The oscillation device 37 oscillates the carriage 30 while it is moving forward. Once the carriage reaches a desired position, the first oscillation is ceased, see FIG. 40) for example, preferably at the first position, prior to the oscillation. The carriage 30 is moved along cutting axis 18 without oscillation and continues to cut through the portions of article 80 that the blade 60 encounters. At a time prior to the blade 60 severing the article 80 into two pieces or otherwise completing a cutting operation, the oscillation device 37 is restarted thereby oscillating carriage 30 in a desired manner, generally along axis 19 perpendicular to the cutting axis 18 in a preferred embodiment. The second oscillation step, see FIG. 4D) for example, is continued until the cutting operation is finished and the desired finished article 80 is produced. After the cutting operation is performed, the carriage can be returned to its initial starting point, see FIG. 4A).

One or more arms 42 are connected to the cutting blade mount plate 36. The cutting knife or blade 60 is connected to arm 42. As illustrated in the figures, blade 60 is connected between two arms 42. Blade 60 has a cutting edge 62 that is linear in a preferred embodiment, and is situated at a desired angle with respect to cutting axis 18. The cutting knife or blade 60 can be connected to the arm 42 in a manner so that the cutting edge 62 has an axis that is situated at an angle of about 80° to about 110°, desirably from about 85° to about 105°, preferably from about 90° to about 100° in relation to the cutting axis 18. In one embodiment, the blade 60 has a cutting edge that has either a single bevel or double bevel in order to provide the desired cutting action. In one embodiment, the cutting edge 62 has an axis that is situated along axis 19 that is perpendicular to cutting axis 18. Blade 60 is connected to arms 42 utilizing any suitable method. For example, in one embodiment, the blade 60 is bolted to the blades, but obviously other fastener connections can be utilized.

Figure 4B:
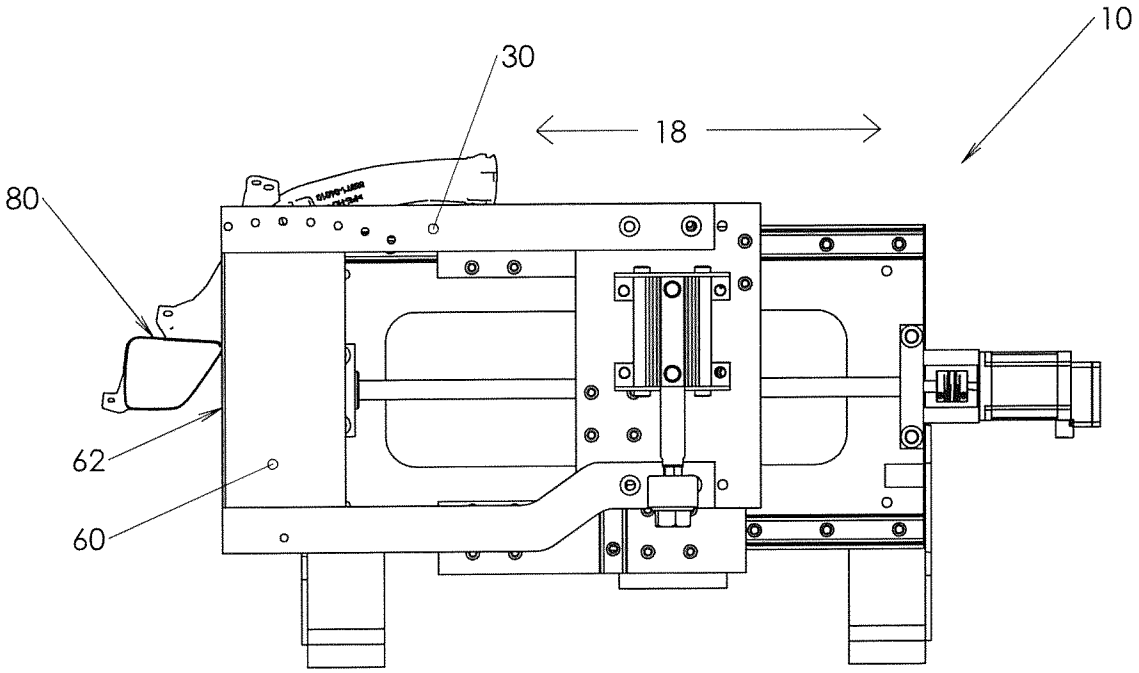
Figure 4C:
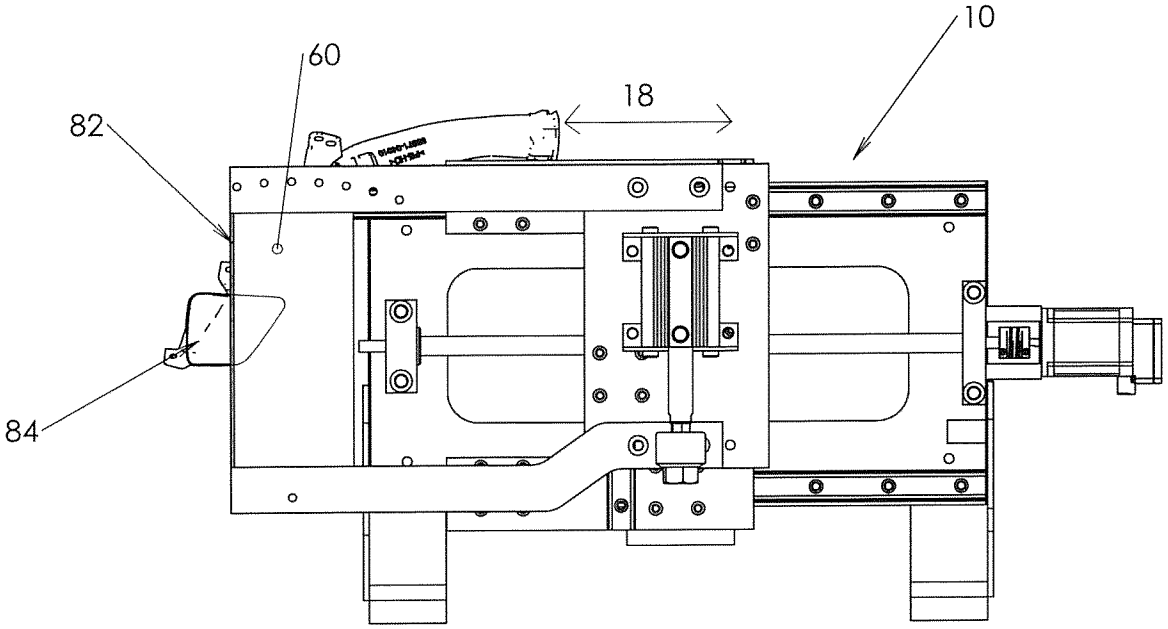
Figure 4D:
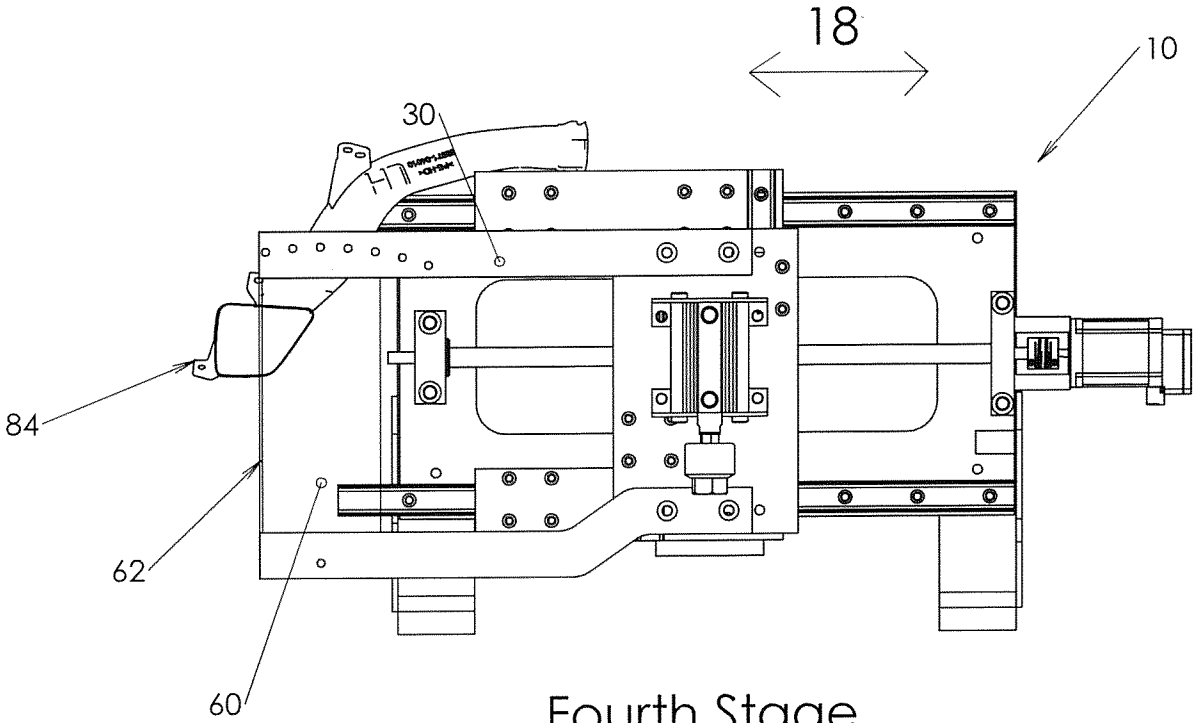

Methods of utilizing the device of the present invention will now be explained utilizing FIG. 4 as a guide. An article 80 to be processed is located adjacent cutting device 10, and preferably secured utilizing a suitable fixture, if desired or necessary, see FIG. 4A). The article 80 has a leading edge or first end 82 positioned adjacent the cutting edge 62 of blade 60 and a trailing edge or second end 84 generally opposite the first end 82. The carriage 30 is advanced along cutting axis 18 towards article 80 and upon or prior to engagement of cutting edge 62 with the first end 82 of article 80, carriage 30 is oscillated with oscillating device 37. First oscillating contact of cutting edge 62 with first end 82 of article 80 is illustrated in FIG. 4B). The arrows illustrate the movement of carriage 30 forward along cutting axis 18 as well as lateral oscillating movement of carriage 30. After the cutting edge 62 has performed the desired cutting operation along cutting axis 18 with oscillation, the oscillation operation is ceased, see FIG. 4C), and the carriage 30 is moved further forward along cutting axis 18 and through the desired portion of article 80. Once the carriage 30 reaches a location near the second end 84, a second oscillation step is performed such as illustrated in FIG. 4D) while the forward motion is maintained along axis 18 and the cutting edge of blade 60 severs or otherwise cuts through the desired portion of article 80. After the cutting operation has been performed, the carriage is returned to an initial or desired position, see FIG. 4A) for example.

In various embodiments, the first oscillation step can be performed until the knife edge has entered the part reaching a point where the cutting direction is inline with the wall being cut. Cutting edge has cut through up to 45%, and desirably up to 20% of the length of article 80 measured along the cutting axis 18. Likewise, the second oscillation step can be initiated prior to 45%, and desirably less than 20% of the length of article 80 remaining to be cut along axis 18.

Utilizing the methods of the present invention, finished, hollow, articles having at least one open end are formed having a clean, substantially straight edge about the opening formed by the multiple step cutting methods of the present invention.

In accordance with the patent statutes, the best mode and preferred embodiment have been set forth; the scope of the invention is not limited thereto, but rather by the scope of the attached claims.

What is claimed is:

1. A cutting device, comprising:

a frame and a carriage movable in relation to the frame along a cutting axis, an oscillating device connected to the carriage and arranged to selectively oscillate the carriage on a second oscillating axis arranged at an angle of about 35° to 90° in relation to the cutting axis, and a cutting blade having a cutting edge for cutting the object operatively connected to the carriage, wherein a guide rail assembly is connected to the frame for moving the carriage along the cutting axis, wherein the guide rail assembly includes one or more guide rails that engage with one or more carriage bearings of the carriage, wherein a drive system is present on the guide rail assembly and drives the carriage along the cutting axis when a motor of the drive system is actuated, wherein a carriage mount plate is connected to the one or more carriage bearings, wherein the carriage includes a carriage guide rail assembly and has a carriage guide rail fixedly connected to the carriage mount plate, wherein the carriage guide rail assembly includes oscillating axis bearings whereby the carriage guide rail and oscillating axis bearings are arranged so that the carriage can be moved on the second oscillating axis.

2. A cutting device according to claim 1, wherein the oscillating device utilizes two limit sensors to oscillate the carriage between a first position and a second position along the oscillating axis.

3. A cutting device according to claim 2, wherein the oscillating axis is arranged from about 45° to 90° in relation to the cutting axis.

4. A cutting device according to claim 1, wherein the drive system is a screw drive including a screw connected to the guide rail assembly, wherein the screw drive has a nut operatively connected to the screw that is connected to the carriage for moving the carriage along the cutting axis when the motor is actuated.

5. A cutting device according to claim 1, wherein the carriage includes one or more arms connected to a cutting blade mount plate of the carriage, wherein the cutting blade is connected to the one or more arms with the blade having a cutting edge having an axis that is situated at an angle of about 80° to about 110° in relation to the cutting axis.

6. A method for cutting an object having a wall and at least one hollow portion, comprising the steps of:

obtaining the object;

cutting the object with the device according to claim 1 using at least two different cutting sequences, including an oscillation step wherein a blade is oscillated while first contacting and cutting into a portion of the object followed by a second step of cutting the object without oscillating the blade.

7. A method according to claim 6, wherein the method further includes the step of oscillating the blade for a second time after the second step of cutting the part without oscillating the blade.

8. A method according to claim 7, wherein the blade is oscillated prior to and during the first contact with the part in a direction other than along a cutting axis.

9. A method according to claim 8, wherein the blade is oscillated at an angle of about 35° to about 90° in relation to the cutting axis.

10. The method according to claim 6, wherein the oscillation step is performed until a cutting edge of the blade has cut through up to 45% of a length of the object as measured along a cutting axis.

11. The method according to claim 10, wherein the second step is followed by a third step that includes oscillating the blade for a second time and maintaining oscillation until the cutting edge cuts the object into two different pieces.

12. The method according to claim 11, wherein the third step is initiated prior to 45% of the length of the article remaining to be cut along the cutting axis.

13. A cutting method for objects having a hollow portion, comprising the steps of:

obtaining an object to be cut;

obtaining the cutting device according to claim 1;

moving the carriage towards the object along the cutting axis and oscillating the cutting blade prior to and/or during first contact of the object with the cutting blade; and ceasing oscillation of the cutting blade after a period of time and continuing to cut the object with the cutting blade along the cutting axis.

14. The method according to claim 13, further including the step of resuming oscillation of the cutting blade after the non-oscillation step and cutting the object into at least two different pieces while the cutting blade is oscillated.

15. The method according to claim 14, wherein the cutting blade is moved along the cutting axis during the second oscillation step.

16. The method according to claim 15, wherein the oscillation step is performed until a cutting edge of the blade has cut through up to 45% of a length of the object as measured along a cutting axis.

17. The method according to claim 16, wherein the oscillation step is performed until a cutting edge of the blade has cut through up to 20% of a length of the object as measured along a cutting axis.

* * * * *